US005421525A

United States Patent [19]

Gray et al.

[11] Patent Number: 5,421,525

[45] Date of Patent: Jun. 6, 1995

[54] FILTERING PARTICULATE CELLULOSIC-BASED MATERIAL

[75] Inventors: Gary E. G. Gray, Coventry; Philip Pennicott, Stockport, both of United Kingdom

[73] Assignee: Courtaulds Fibres (Holdings) Limited, London, United Kingdom

[21] Appl. No.: 283,148

[22] Filed: Aug. 1, 1994

Related U.S. Application Data

[62] Division of Ser. No. 67,427, May 24, 1993, Pat. No. 5,370,322.

[51] Int. Cl.[6] ..... B02C 7/00; B02C 17/02

[52] U.S. Cl. ..... 241/19; 241/28

[58] Field of Search ..... 241/18, 19, 24, 28; 106/163.1, 186, 203

[56] References Cited

U.S. PATENT DOCUMENTS

| | | | |
|---|---|---|---|
| 2,972,171 | 2/1961 | Heritage | 241/28 X |
| 3,411,720 | 11/1968 | Jones et al. | 241/28 |
| 4,504,016 | 3/1985 | Wikdahl | 241/28 X |
| 4,572,440 | 2/1986 | Tao | 241/28 X |
| 5,133,507 | 7/1992 | Sepling | 241/28 X |

*Primary Examiner*—Timothy V. Eley

*Attorney, Agent, or Firm*—Davis Hoxie Faithfull & Hapgood

[57] ABSTRACT

A method is provided for filtering shredded cellulose-based material, for example to enable the formation of a mixture containing cellulose dispersed in a solvent for cellulose such as amine oxide. The shredding operation creates both fine particles of cellulosic material ("pulp dust") and large particles of cellulosic material, The shredded cellulosic material is passed through a separator to separate the pulp dust from the large particles of cellulosic material and the pulp dust is subsequently recovered in a filtering process.

4 Claims, 5 Drawing Sheets

FILTERING PARTICULATE CELLULOSIC-BASED MATERIAL

This is a division of our application Ser. No. 08/067,427 filed May 24, 1993, now U.S. Pat. No. 5,370,322.

BACKGROUND OF THE INVENTION

This invention relates to apparatus for, and a method of, filtering solid cellulose-based material. In particular, the invention is concerned with preventing wastage of cellulosic material when fine particles, e.g. "pulp dust", of the cellulose-based material are created during shredding or comminuting of the cellulose-based material in sheet, roll or flock form. The invention also relates to forming a mixture containing cellulose dispersed in a solvent therefor, the mixture suitably forming a so-called "premix" prior to being subjected to heat and pressure to dissolve the cellulose in the solvent and to create a dope which can be subsequently shaped and extruded to form a cellulosic product, such as a fiber or filament.

McCorsley et al U.S. Pat. No. 4,211,574, McCorsley et al U.S. Pat. No. 4,142,913 and McCorsley U.S. Pat. No. 4,144,080 all disclose methods of making solid precursors of cellulose dispersed in amine oxide. In each of these known methods, cellulose is suspended in a mixture which is a non-solvent for the cellulose at the temperature of the suspension and which contains a tertiary amine oxide and water. The solid product which is produced is cellulose containing amine oxide and some water. On heating the solid product, which is suitably in the form of chips, the cellulose is dissolved to form a solution having a viscosity suitable for spinning. Although references are made to the cellulose being formed of comminuted wood pulp, there is no disclosure in these prior patents on how the wood pulp should be comminuted and whether any attempt is made to retrieve wood pulp dust created during the comminution of the wood pulp.

McCorsley U.S. Pat. No. 4,416,698 in the preparation of a cellulose dope it is disclosed that, at elevated temperatures, cellulose dissolves rapidly and forms a solution of cellulose in tertiary amine N-oxide of more uniform composition when the tertiary amine N-oxide containing the preferred amount of water and the cellulose are ground to the same predetermined particle size and charged simultaneously to the barrel of an extruder. Typically the cellulose and tertiary amine N-oxide are ground in a mill through a 0.5 mm screen, the cellulose particle size being reduced without significant degradation of the cellulose molecular weight. In the extruder the mixture is heated to dissolve the cellulose in the tertiary amine N-oxide-water mixture to form a dope prior to extrusion to form a filament or film. However again no reference is made to retrieval of wood pulp dust created during the grinding of the cellulose.

In practice we have found that in order to produce high quality cellulose mixtures having a relatively high solids contents, it is desirable for cellulosic material, e.g. from rolls or sheets of wood pulp or wood pulp flock, to be shredded into relatively large flakes or particles, e.g. from 1 to 20 $cm^2$, with the cellulosic material being compressed as little as possible at its cut edges. However we have found that typically, in the process of shredding and comminuting the cellulosic sheet material, a significant amount, e.g. up to about 2% by weight, of the cellulosic sheet material is converted into pulp dust which is conventionally lost to the process.

SUMMARY OF THE INVENTION

An object of the present invention is to return or recycle pulp dust, created during shredding and comminuting of cellulosic material, to the larger comminuted particles or flakes of pulp of cellulosic material produced during shredding.

Another object of the present invention is to form a mixture of shredded or comminuted cellulosic material dispersed in a solvent for cellulose, e.g. containing a tertiary amine N-oxide.

A further object of the present invention is to convey in a stream of air or gas shredded cellulosic material to separating means and to separate larger flakes of cellulosic material from the conveying air stream and finer particles of cellulosic material, e.g. pulp dust. The finer particles of cellulosic material are then filtered from the conveying air or gas stream and recombined with the larger particles of cellulosic material.

According to one aspect of the present invention apparatus for shredding solid cellulose-based material comprises a shredding device for comminuting cellulosic material into particulate cellulosic material of different sizes and having an outlet, separating means having an inlet, a first outlet, a second outlet and a separating device, conveying means for conveying particulate cellulosic material exiting from the outlet of the shredding device in a gaseous stream to the inlet of the separating means, the separating device being arranged to separate from the particulate material conveyed in the gaseous stream larger particles of the particulate cellulosic material and to convey them to said second outlet, the finer particles of particulate cellulosic material exiting in the gaseous stream from said first outlet, filtering means for extracting the finer particles of particulate cellulose material conveyed in the gaseous stream and exiting from the first outlet of the separating means, and recombining means including ducting for recombining the finer particles of particulate cellulosic material extracted by the filtering means with the larger particles exiting from said second outlet of the separating means.

Preferably the separating device comprises a screen arranged between the inlet and the first outlet of the separating device.

Conveniently the filtering means comprises a plurality of filter sleeves each having a tubular filtering wall, means for drawing air loaded with particulate cellulosic material radially inwardly through the filtering walls so as to deposit the particulate cellulosic material on the outside of the filtering walls, air means for periodically inflating the filter screens to cause any deposited particulate material to fall into a collection device and outlet means for delivering the deposited particulate cellulosic material from the collection device to the second delivery means. The second delivery means may include a cyclone separator for separating particulate cellulosic material from the conveying air.

Preferably the second delivery means has an outlet which opens into the ducting of the first delivery means. However, in a less preferred alternative design, the second delivery means may open directly into the second inlet means.

According to another aspect of the present invention, there is provided a method of shredding solid cellulose-based material comprising shredding cellulosic material into particulate material, separating larger particles of the shredded cellulosic material from a conveying gaseous stream, filtering from the conveying gaseous stream finer particles of shredded cellulosic material which remain after separation of the larger particles of shredded cellulosic material, and recombining the filtered finer particles of shredded cellulosic material with the separated larger particles of shredded cellulosic material.

According to other aspects of the present invention there are provided an apparatus and a method of forming a solution containing cellulose dissolved in a solvent for cellulose. Preferably the solvent for cellulose includes water and/or another non-solvent for cellulose.

Conveniently the solvent for cellulose comprises any suitable tertiary amine oxide which is compatible with water. Preferred tertiary amine oxides are cyclic mono (N-methylamine-N-oxide) compounds such as, for example, N-methyl-morpholine-N-oxide, N-methylpiperidine-N-oxide, N-methylpyrrolidone-oxide, dimethylcyclohexylamine oxide and the like.

BRIEF DESCRIPTION OF THE DRAWINGS

An embodiment of the invention will now be described, by way of example, with particular reference to the accompanying drawings, in which.

DESCRIPTION OF THE PREFERRED EMBODIMENT

Figure 1:
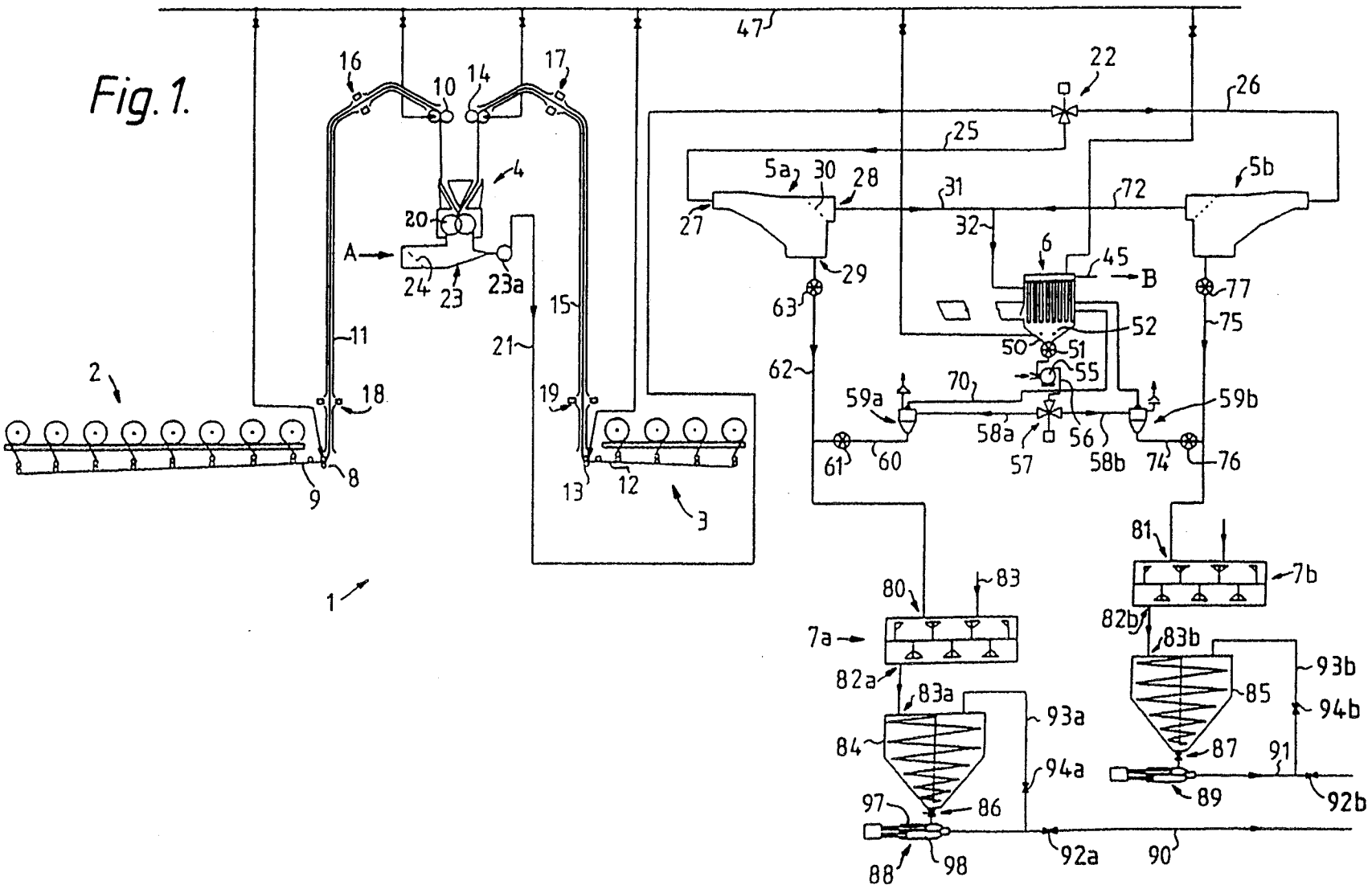
FIG. 1 is a schematic representation of apparatus for forming a mixture containing at least cellulose and a solvent for the cellulose.

FIG. 1 shows schematically apparatus, generally designated by the reference numeral 1, for forming a mixture of cellulosic material dispersed in a solvent for the cellulose. The apparatus 1 comprises a first set of pulp rolls 2, a second set of pulp rolls 3, a pulp shredding device 4 and associated fan 23, pulp separators 5*a* and 5*b*, filtering means 6, premixer 7*a* and 7*b*, storage hoppers 84 and 85 and reciprocating dual piston pumps 88 and 89.

A multi-layered first web 9 of cellulosic material is formed by drawing webs from the first set of pulp rolls 2 using a lower pair of nip rolls 8 and an upper pair of nip rolls 10. In its path between the nip rolls 8 and 10, the first web 9 is fed between a pair of spaced apart web guide plates 11. A multi-layered second web 12 of cellulosic material is also formed by drawing webs from the second set of pulp rolls 3 using a lower pair of nip rolls 13 and an upper pair of nip rolls 14. The second web is guided between the nip rolls 13 14 by means of spaced apart guide plates 15. The guide plates 11 and 15 are positioned between the nip rolls 8 and 10 and 13 and 14, respectively, so as to guide the multi-layered webs 9 and 12 between the nip rolls without the need for operator interaction. Preferably the guide plates 11 and 15 are hinged for access in case during use there is a blockage between the guide plates.

As can be seen in FIG. 1, there are eight pulp rolls in the first set of pulp rolls 2 and four pulp rolls in the second set of pulp rolls 3. Pulp rolls are supplied to end users on the basis of the viscosity of a liquid product produced in a predetermined manner from the pulp material. Although viscosity ratings vary from batch to batch, an end user can select stock rolls having viscosity ratings from pre-selected viscosity bands. Since it has been found that a better quality of cellulosic premix is obtained by mixing together rolls having high and low viscosity ratings in order to produce a "mix" of pulp materials having a desired intermediate viscosity rating, the rolls in the first set of pulp rolls 2 have a viscosity rating in a lower value band and the rolls in the second set of pulp rolls 3 have a viscosity rating in a higher value band. The speed of travel of the webs 9 and 12 to the shredding device 4 is controlled to provide a mixture of pulp material having the desired viscosity rating.

In order to produce a consistent premix, it is important to accurately control the amount of cellulose which is added to the premixers 7*a* and 7*b* for mixing. Since pulp rolls contain both cellulose and water, it is necessary to determine the water content of the pulp rolls and to derive the bone-dry weight of cellulose present. In the simplest form, shredded pulp from the shredding device 4 can be weighed in weighting apparatus (not shown) before the desired weight of pulp is added to the premix 7*a* or 7*b*. If this method is employed, it is assumed that the pulp rolls consist of a set percentage by weight of cellulose and a set percentage by weight of water, e.g. 94% by weight of cellulose and 6% by weight of water. Preferably, however, the bone-dry weight of pulp material is calculated as it is fed to the shredding device with the use of sensing means 16 and 17 sensing the webs 9 and 12, respectively.

Each sensing means 16, 17 comprises a beta ray scanner for measuring the weight per unit area of the composite layered web 9 or 12 and optionally also comprises a moisture measuring device employing microwave absorption techniques to measure the moisture content of the web 9 or 12. If moisture measurement is not employed, the moisture content of each web is considered to be about 6% by weight of the web, the remaining 94% by weight being cellulose. With signals for the weight per unit area of each web 9, 12, the width of each web and the moisture content of each web, the amount of cellulose delivered to the shredding device 4 can be calculated and this figure used to control the amount of cellulose added to each premixer.

Metal detectors 18 and 19 are also provided to detect for the undesirable presence of metal within the webs 9 and 12. If metal is detected the process can be automatically stopped.

The multi-layered first and second webs 9 and 12 of cellulosic material are fed into the inlet of the shredding device 4 where the webs are cut or comminuted into irregular flakes or particles of pulp material. The shredding device 4 is provided with rotating cutter knives 20 which are designed to cut or tear the cellulosic web material with minimum compression of the cut edges of the web material. This is desirable so that the cut web material is later better able to expand and mix with amine oxide and water. A particular preferred typed of pulp shredder is the cutter manufactured by Ulster Engineering and marketed by Birkett Cutmaster Limited known as the "AZ 45 Special". Such a shredder is provided with a knife type cutter (type 31 mm ×7 hook). The rotating knives 20 of the shredding device 4 rotate at approximately 140 rpm and cut the cellulosic material into irregular shapes or flakes up to about 1 to 20 $cm^2$, typically from about 3 to 15 $cm^2$. However, in addition to producing these relatively large flakes or particles of cellulosic material, the cutter knives also generate a quantity of much finer cellulosic particles or "pulp dust". Typically, during the web shredding process, up to 99% of the web material is cut into these larger flakes or particles of cellulosic material with the remaining 1% being formed into pulp dust.

The cut and shredded pulp material, including the pulp dust, exits from the outlet of the shredding device 4 and is conveyed via circular section ducting 21 to a diverter valve 22. The pulp material is conveyed in an air stream created by the air fan 23 at the outlet of the shredding device 4 which sucks in air at air inlet A through a filter 24. This fan has vanes which are fitted with cutting blades and these help to shred and break up further the particles of cellulosic material exiting from the shredding device 4.

The process operates as a batch process and, depending on which part of the batch process is in operation, the diverter valve 22 directs the cut pulp from ducting 21 either via ducting 25 to the pulp separator 5*a* or via ducting 26 to the pulp separator 5*b*. Each of the pulp separators 5*a* and 5*b* operates in a similar manner and only pulp separator 5*a* will be described in detail hereafter.

The pulp separator 5*a* has an inlet 27, a first outlet 28 arranged in line with the first inlet 27 and a second outlet 29 offset from a path between the inlet 27 and first outlet 28. A mesh screen 30 is arranged at an angle between the direct path between the inlet 27 and first outlet 28. In use, the cut pulp material including the pulp dust is conveyed in a stream of air via the ducting 25 through the inlet 27 and is directed towards the first outlet 28. The mesh screen 30 has a mesh size of 0.1 inch and allows the pulp dust, up to a particle size of 0.1 inch and the conveying air stream to pass therethrough and out through the first outlet 28. The larger particles of cut cellulosic material which are too large to pass through the mesh of the screen 30, are deflected by the angled screen 30 downwardly through the second outlet 29. The pulp dust and conveying air stream which exits from the first outlet 28 is passed via ducting 31 and 32 to an inlet of the filtering means 6.

Figure 2A:
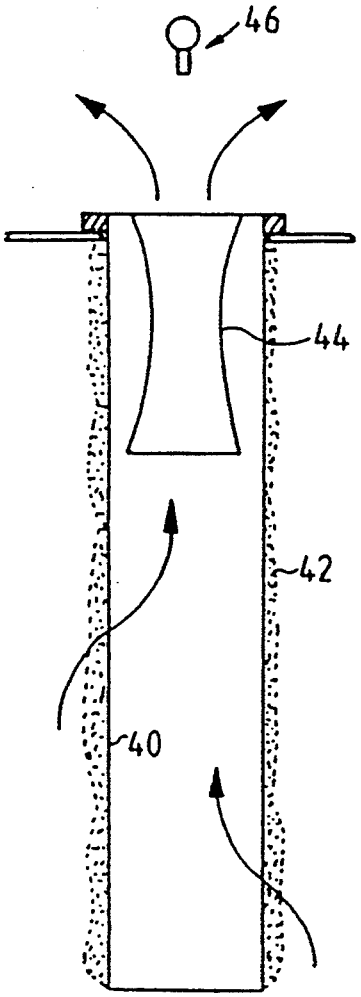
FIGS. 2*a* and 2*b* are schematic side and sectional views, respectively, showing particulate material being deposited on the outside of a filtering sleeve.
Figure 3A:
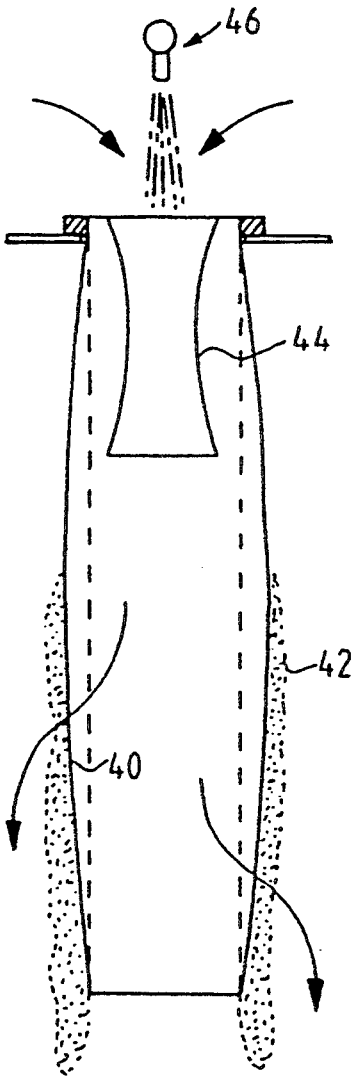
FIGS. 3*a* and 3*b* are schematic side and sectional views, respectively, showing particulate material previously deposited on the outside of a filtering sleeve being removed therefrom.
Figure 2B:
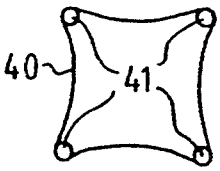
Figure 3B:
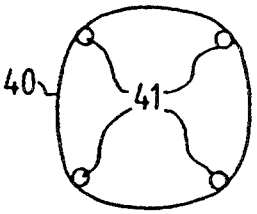

The filtering means 6 serves to extract the pulp dust from the conveying air stream. A particularly suitable form of filtering means 6 comprises the JETLINE V filter manufactured by NEU Engineering Limited of Woking, Surrey, England. Such a filtering means 6 has a plurality of filter sleeves 40 (see FIGS. 2*a*, 2*b*, 3*a*, 3*b*) arranged vertically in rows, e.g. twelve rows of eight filter sleeves per row. Each filter sleeve 40 of just under 1 $m^2$ gives a total area for all 96 sleeves of 100 $m^2$ square section conveniently comprises a needle-felt sleeve which is supported on a rigid vertical frame 41 made of anti-corrosion steel wire. The filtering means 6 operates under positive pressure, the pulp dust laden inlet air being blown upwardly and radially inwardly, through the tubular filter sleeve 40 in the direction of the arrows in FIG. 2*a*. A "cake" 42 of pulp dust builds up on the outside of the sleeves 40 and "clean" air is conveyed upwardly through a venturi shaped outlet tube 44. Clean air exits at 45 (see FIG. 1) in the direction of arrow B.

The cakes 42 of pulp dust are removed from the filter sleeves 40 by pulsing air periodically downwardly through the integral venturi tube 44, with each row of filter tubes being cleaned in turn. Each cleaning process involves injecting compressed air downwardly via duct 46 from compressed air line 47 into each sleeve 40 via the venturi tube 44. This momentarily reverses the air flow through the filter sleeve and abruptly inflates the filter sleeve thus throwing off the cake of pulp dust (see FIG. 3*a* and 3*b*). The pulp dust removed from the filter sleeves 40 drops into a storage hopper 50 at the bottom of the filtering means 6. The storage hopper 50 has four sides angled inwardly and downwardly towards a rotary valve 51. Each of the four walls of the hopper 50 are provided with a pair of blow nozzles 52 which are periodically operated to prevent the pulp dust accumulating on the angled side walls of the hopper 50.

On rotation of the rotary valve 51 and on operation of the pulp dust fan 55, pulp dust is conveyed via ducting 56 to a diverter valve 57. Depending on which "batch" path is in operation, the diverter valve 57 either diverts the flow of pulp dust via ducting 58*a* to cyclone separator 59*a* or via duct 58*b* to cyclone separator 59*b*. Assuming the diverter valve 57 is set to divert the pulp dust and conveying air to the cyclone separator 59*a*, pulp dust exits from the latter and is conveyed via ducting 60 to T-into a duct 62 leading from the second outlet 29 of separator 5*a*. A rotary valve 61 is provided in ducting 60 and a further rotary valve 63 is provided in ducting 62 adjacent its inlet end. Provided these valves 61 and 63 are turning, the pulp dust conveyed via ducting 60 is re-combined with the larger particles of cut cellulosic material separated by the pulp separator 5*a*. Outlet air from the cyclone separator 59*a* is cycled back to the separating means 6 via ducting 70 in order to extract any further pulp dust which still might be present in the air exiting from the cyclone 59*a*.

The separator 5*b* is brought into operation when the diverter valve 22 is set to divert the cut pulp and conveying air via ducting 26. Pulp dust exists from the first outlet of the separator 5*b* and is conveyed via ducting 72 and 32 to the filtering means 6. The diverter valve 57 ensures that pulp dust from the filtering means 6 is diverted via ducting 58*b* to the cyclone separator 59*b* from where pulp dust passes via outlet 74 for re-combination with coarser particles of cellulosic material separated in the separator 5*b* and exiting via ducting 75. This re-combination of pulp dust proceeds when rotary valves 76 and 77 are operational and not in their stationary condition.

Approximately 1,000 lb of wood pulp is processed in each batch and four batches are processed each hour. Thus of the 4,000 lb of wood pulp processed each hour, approximately 1% (i.e. 40 lb) of pulp dust is re-combined with the larger particles of cut pulp material. Without the provision of the filtering means 6, this amount of wood pulp dust would have been lost to the process.

The shredded pulp and pulp dust from the ducting 62 and 75 is fed to inlets 80 and 81, respectively, of the premixers 7*a* and 7*b*, respectively, depending on which batch is being processed. Each of the inlets 80 and 81 is conveniently heated by means of a hot water jacket 82 (see FIG. 4) through which hot water, e.g. at 120° F., is circulated. The hot water is supplied via hot water supply pipe 82*a* and is returned via hot water return pipe 82*b*.

Since the premixers 7*a* and 7*b* are substantially identical, only premixer 7*a* will be described in detail. The premixer 7*a* has four further inlets 83 (only one of which is shown) for the introduction therein of a water solution of tertiary amine oxide, the mixture consisting of 78% parts by weight of amine oxide and 22% parts by weight of water. A particularly preferred tertiary amine oxide is N-methyl-morpholine-N-oxide. The temperature of the amine oxide solution is carefully controlled to a desired temperature of approximately 180° F., e.g. 176° F., prior to its introduction into the premixer. The amount of amine oxide solution introduced into the premixer 7*a* is carefully controlled by a mass flow meter and a valve 83*c* in supply line 83*d* so as to produce a mixture with the added pulp consisting of approximately 13 parts by weight of cellulosic material and 87 parts by weight of amine oxide and water. Typically in each batch approximately 8000 lb of amine oxide solution and approximately 1200 lb of shredded pulp are added to the premixer.

A stabiliser, such as powdered propyl gallate, is also conveniently added to each premixer for mixing with the other materials. The stabiliser is added to prevent or reduce the decomposition of the amine oxide and the decomposition of the cellulose. It is suitably added to the shredded pulp just prior to the latter being introduced into the premixer. Other additives may be added at this stage. Examples of such additives are dulling agents, e.g. titanium dioxide, viscosity modifiers and pigments.

Figure 4:
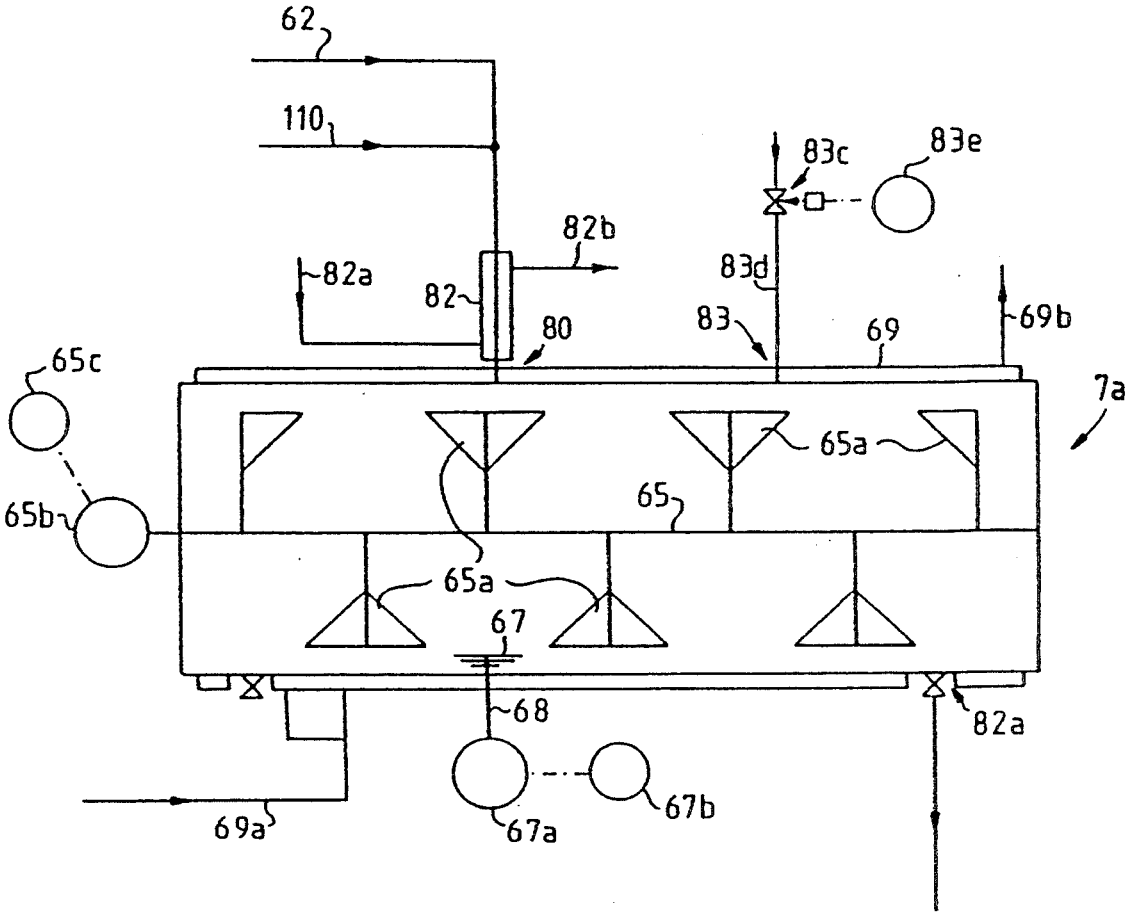
FIG. 4 is a schematic sectional view, on an enlarged scale, of a premixer of the apparatus shown in FIG. 1.

The premixer 7*a* comprises a mixing chamber within which is mounted a horizontal shaft 65 having radial paddles 65*a* extending therefrom. The paddles 65*a* are in the form of plough blade stirrers and extend radially conveniently in different axial planes. The horizontal shaft 65 is driven by an externally mounted motor and rotates relatively slowly at approximately 72 r.p.m.. Mounted in line in the walls of the mixing chamber of the premixer 7*a* are four spaced apart refiner mixers 67 (only one of which is shown in FIG. 4) each driven by an externally mounted motor 67*a* to rotate relatively quickly at speeds of approximately 3000 r.p.m. The axis 68 of rotation of each refiner blade is orthogonal to the axis of rotation of the slowly rotating paddles 65*a*, The quickly rotating refiner mixers 67 which rotate at tip speeds in the range 4 to 6 m/s preferably 5–5.5 m/s are primarily intended to chop up the larger particles of shredded pulp after the latter have swollen in the amine oxide solution. The slowly rotating paddles are intended to mix the introduced components together to facilitate dispersion of the cellulose in the amine oxide solution. The combined actions of the slowly rotating paddles 65*a* and the quickly rotating refiner mixers 67, produces a homogeneously mixed mixture of the cellulosic material dispersed in the amine oxide and water. The items 65*c*, 67*b* and 83*e* shown in FIG. 4 represent part of an electronic computer control system for automatically controlling the entire process and, in particular, the motor 65*b*, the motors 67*a* and a mass flow meter upstream of valve 83*c*, respectively.

The external casing of each premixer, which provides the walls of the mixing chamber, has heating jackets 69 around which hot water, typically at a temperature of about 180° F., e.g. 176° F., is circulated to retain the contents of each mixing chamber at an elevated temperature of about 180° F., e.g. 176° F. Hot water is supplied via supply pipe 69*a* and is returned for re-heating via return pipe 69*b*. Each mixing operation typically takes about 21 minutes to perform. The amine oxide solution is initially loaded into the premixer in about 5 minutes and the pulp and added propyl gallate are subsequently loaded over a period of about 10 minutes. Mixing then proceeds for at least four minutes, typically for about 6 minutes, at an elevated temperature of about 180° F., e.g. 176° F., in which time a high quality mixture is obtained in which the cellulosic material is broken down into discrete individual fibers which are substantially uniformly dispersed in the tertiary amine oxide. The result is a premix having a relatively high cellulose content of about 13%. The premix can subsequently be converted under the action of heat and pressure into a viscous dope in which the cellulose is dissolved in the amine oxide solution, the dope so produced being suitable for subsequently producing cellulosic products. A particularly suitable mixer has been found to be the RT3000 Model Mixer manufactured by Winkworth Machinery Limited at Swallowfield, Near Reading, Berkshire, United Kingdom.

The premixers 7*a* and 7*b* have valved bottom outlets 82*a* and 82*b* which are connected, respectively, to the inlets 83*a* and 83*b* of vertical storage hoppers 84 and 85. The hoppers 84 and 85 have outlets 86 and 87, respectively, which are connected to inlet sides of reciprocating piston pumps 88 and 89, respectively. The pumps 88 and 89 have outlet pipes 90 and 91, respectively, connected to a dope making stage (not shown). Depending on which batch is being processed, the mixture is either passed from premixer 7*a*, via the storage hopper 84 to -the piston pump 88 for conveyance via outlet pipe 90 to the dope making stage or is passed from premixer 7*b*, via the storage hopper 85 to the piston pump 89 for conveyance via outlet pipe 91 to the dope making stage.

The storage hoppers 84 and 85 serve to maintain the mixture formed in the premixers 7*a* and 7*b*, respectively, in a mixed homogeneous condition of the correct consistency and viscosity. Since the storage hoppers 84 and 85 are identical and the reciprocating piston pumps 88 and 89 are identical only storage hopper 84 and piston pump 88 will be described in detail hereafter.

Figure 5:
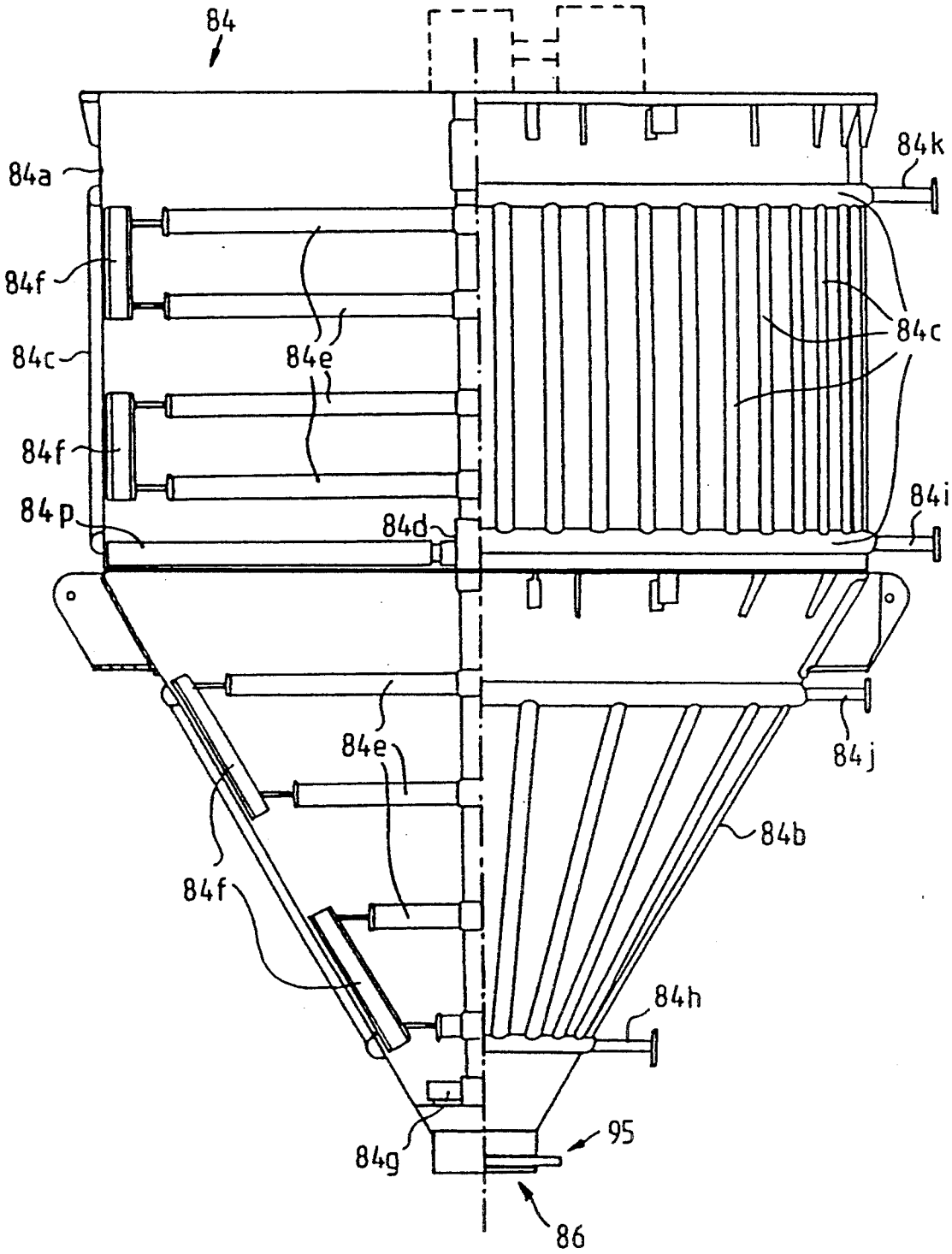
FIG. 5 is a part sectional view, on an enlarged scale, of a storage hopper of the apparatus shown in FIG. 1, and FIGS. 6 and 7 are, respectively, a schematic end sectional view and view from above, on enlarged scales, of part of a reciprocating dual piston pump of the apparatus shown in FIG. 1.

The storage hopper 84 (shown schematically in FIG. 5) is arranged vertically and has a circular cylindrical upper portion 84*a* and a frusto-conical lower portion 84*b*. Heating pipes 84*c* are arranged on the outside of the portions 84*a* and 84*b* for passing hot water around the walls of the hopper to maintain the contents of the hopper at an elevated temperature of about 180° F., e.g. 176° F. Hot water is supplied via inlets 84*h* and 84*i* and is returned via outlets 84*j* and 84*k*. Inside the storage hopper 84, a vertical, axially disposed shaft 84*d* carrying axially spaced apart radial arms 84*e* is rotatable at a relatively slow speed of from 2–10 r.p.m., e.g. 8 r.p.m.. The shaft 84*d* is supported by an upper bearing (not shown), a lower bearing 84*g* and an intermediate bearing carried by radial arms 84*p*. Axially adjacent pairs of the arms 84*e* carry a common stirrer 84*f*, with four such stirrers 84*f* being shown in FIG. 4. These stirrers 84*f* are positioned at the radially outer extremities of the arms 84*e* and in use sweep out stirring paths adjacent the walls of the hopper 84. In use the stirrers 84*f* act to stir premix contained in both the upper portion 84*a* and the lower portion 84*b* of the storage hopper 84. In FIG. 5 only half the numbers of arms 84*e* and stirrers 84*f* are shown since corresponding arms and stirrers (not shown) extend on the right hand side of the hopper 84, each arm on the right hand side being diametrically in line with its corresponding arm 84*e*. The arms 84*e* carrying the upper stirrer 84*f* in the upper portion 84*a* and aligned with (i.e. are in the same axial plane) as the arms 84*e* carrying the upper stirrer 84*f* in the lower portion 84*b*. The arms 84*e* carrying the lower stirrer 84*f* in the upper portion 84*a* and the arms 84*e* carrying the lower stirrer 84*f* in the lower portion 84*b* are also aligned in a common plane which is offset, e.g. 90°, from the axial plane containing the other radial arms 84*e*. It will be appreciated that FIG. 5 is only schematic since the offset radial arms are all shown.

The premix passed into the storage hopper 84 can be kept in a viscous usable condition at the correct elevated temperature for a desired period of time, e.g. up to several hours. The relatively slowly rotating stirrers 84*f* keep the cellulose dispersed in the amine oxide solution so that the mixture remains in a homogeneous condition. The premix can thus be kept in a usable condition for a period of time before being transported to the dope forming stage and serves to provide a useful degree of control in the production process. Thus the storage hopper 84 provides a break in the process and is able to absorb any discontinuities upstream, e.g. caused by having to stop the process for system failures or the like, without the need to discard the already mixed premix.

Figure 6:
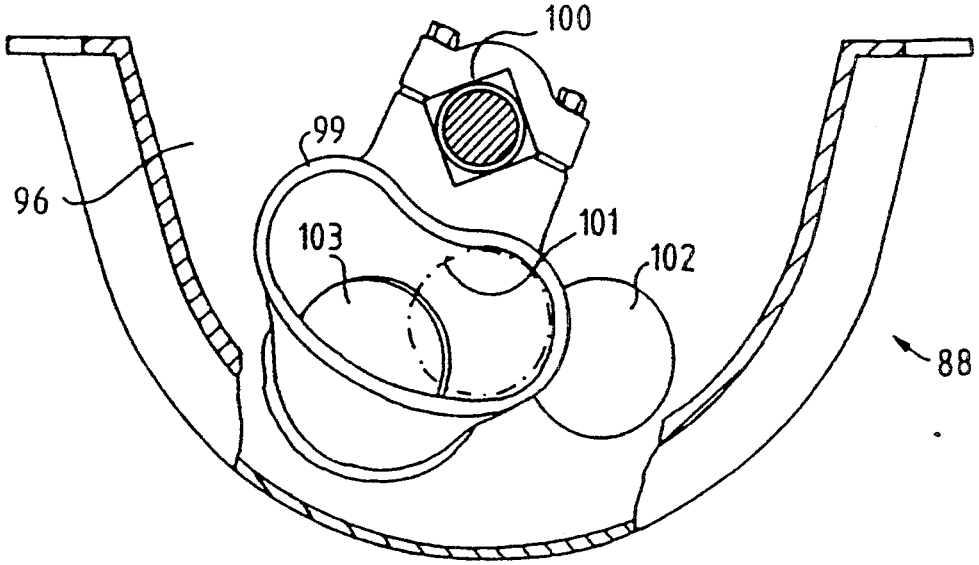
Figure 7:
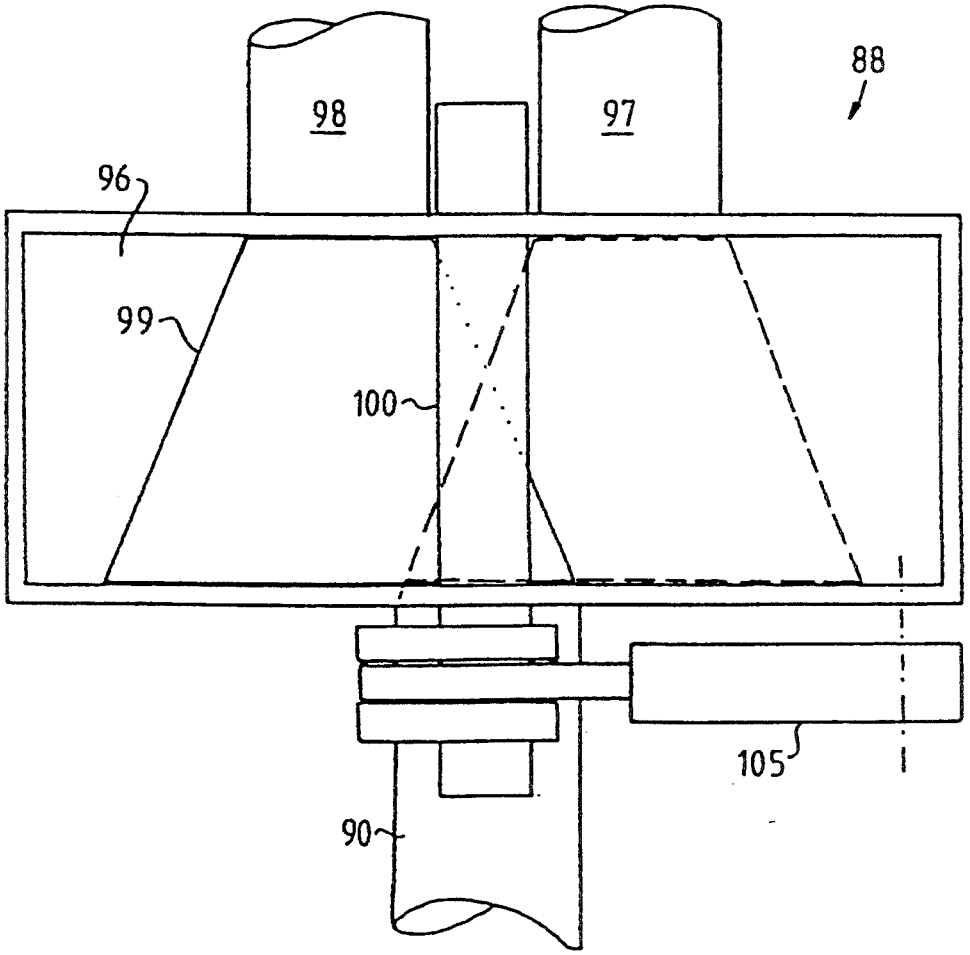

The reciprocating piston pump 88 is a dual piston, hydraulically actuated so-called "concrete pump". A particularly suitable concrete pump is the Schwing Type KSP 17 HD EL pump manufactured by Schwing GmbH. Such a concrete pump 88 is found to be particularly suitable for conveying the premix to the dope forming stage without the premix losing its homogeneity. In use, the premix is delivered, on opening of a valve 95, through an outlet of the hopper 84 into an inlet 96 (see FIGS. 6 and 7) of the pump 88. On the suction stroke of one of the pistons of the dual piston pump, the premix is drawn through the outlet of the hopper into one of the two cylinders 97, 98 of the pump 85. On the subsequent forward discharge stroke of the piston, the premix previously drawn into the cylinder is pushed forward through a transfer tube 99 for conveyance through the outlet pipe 90. The transfer pipe 99 is mounted on pivot shaft 100 and, on actuation of an hydraulic ram 105, is pivotally movable between a position shown in full lines in FIG. 7 in which the cylinder 98 is connected to the pipe 90 and a position shown in dashed lines in FIG. 7 in which the cylinder 97 is connected to the pipe 90. Alternatively flow from the alternate cylinders can be controlled by poppet valves. In FIG. 7, opening 101 (shown in chain lines) is the inlet of the outlet pipe 90 and openings 102 and 103 are at the ends of the cylinders 97 and 98, respectively. The operation of the transfer pipe 100 and of the rest of the pump 88 is described in more detail in Schwing U.S. Pat. No. 4,373,875 the entire contents of which are incorporated herein by way of reference. The reciprocating piston pump 88 is found to be robust in use and provides a positive pumping action for conveying the cellulosic premix. The relatively slowly reciprocating pistons do not "squeeze out" and separate the amine oxide from the cellulose to any significant degree and do not break down the cellulose. This is primarily because a large proportion of the kinetic energy of the moving pistons is used to move the premix. Moreover the pump acts as a metering pump. Since the volume of each cylinder is known and since each cylinder is filled with premix on a suction stroke, the amount of premix discharged on each discharge stroke can be accurately determined. Thus the amount of premix being conveyed over a period of time can be accurately controlled by controlling the speed of the reciprocating pistons. The pump is relatively reliable in use, does not cause the cellulose to be separated out from the amine oxide and accurately meters the premix. The premix contains approximately 13% by weight of cellulose and the reciprocating piston pump is able to pump the premix reliably and effectively.

The premix from the pumps 88, 89 is conveyed via hot water traced pipes 90,91 to a dope forming stage, the dope so formed subsequently being shaped and regenerated into a cellulosic product, such as a fiber, filament, rod, tubing, plate or film. The pipes 90 and 91 are provided with valves 92*a* and 92*b*, respectively, and recirculating pipes 93*a* and 93*b* are connected upstream of the valves 92*a* and 92*b* for connecting the outlets of the pumps 88 and 90 to inlets of the storage hoppers 7*a* and 7*b*. The recirculating pipes 93*a* and 93*b* incorporate valves 94*a* and 94*b*, respectively. By closing the valves 92*a* and 92*b* and opening the valves 94*a*, 94*b* and 95, premix can be pumped around closed circuits including the storage hoppers 7*a* and 7*b* without having to be pumped to the dope forming station.

In the apparatus described much of the piping is lagged. In particular the hot water supply lines 83*d* and 96*a* and the supply lines (not shown) connected to hopper inlets 84*h* and 84*i* are lagged as are the lines connecting premixer outlets 82*a* and 82*b* to the storage hopper inlets 83*a* and 83*b*, respectively. The outlet pipes 90 and 91 are also lagged.

Although not shown and described in detail herein, the steps of controlling the feeding of web from the paper rolls to the shredding apparatus, of supplying the shredded pulp to the premixers including the step of recovering fine particles filtered from the shredded pulp, of adding desired quantities of premix constituents to the premixers, of mixing the premix constituents in the premixers, of stirring the formed premix in the storage hoppers and of pumping the premix to a dope forming stage is preferably automatically controlled under computer control.

We claim:

1. A method of forming a mixture containing cellulose dispersed in a solvent for cellulose, the method comprising shredding cellulosic material into particulate material, separating a first particle fraction comprising particles of the shredded cellulosic material having an average diameter equal to or greater than a predetermined value from a conveying gaseous stream and delivering said separated first particle fraction to a premixer, filtering from the conveying gaseous stream a second particle fraction comprising particles of shredded cellulosic material having an average diameter less than said predetermined value which remain after separation of said first particle fraction, delivering the filtered second particle fraction to the premixer, introducing said solvent for cellulose into the premixer and mixing in the premixer the particles of shredded cellulosic material delivered to the premixer with at least said solvent for cellulose introduced into the premixer.

2. A method according to claim 1, in which the solvent for cellulose includes a non-solvent for cellulose.

3. A method according to claim 2 wherein the non-solvent comprises water.

4. A method according to claim 1, in which the solvent for cellulose comprises a tertiary amine oxide.

* * * * *

UNITED STATES PATENT AND TRADEMARK OFFICE

CERTIFICATEOF CORRECTION

PATENT NO. : 5,421,525

DATED : June 6, 1995

INVENTOR(S) : Gary E.G. Gray

It is certified that error appears in the above-identified patent and that said Letters Patent is hereby corrected as shown below:

| | | |
|---|---|---|
| Col. 7, | line 46, | after "65a", insert--which rotate at tip speeds in the range 4-6 m/s preferably 5-5.5 m/s--. |
| Col. 7, | lines 47, 48, | after "67", delete "which rotate at tip speeds in the range 4 to 6 m/s preferably 5-5.5 m/s". |

Signed and Sealed this

Thirtieth Day of July, 1996

Bruce Lehman

*Attest:*

BRUCE LEHMAN

*Attesting Officer*

*Commissioner of Patents and Trademarks*